US011322858B2

(12) United States Patent
Xie et al.

(10) Patent No.: US 11,322,858 B2
(45) Date of Patent: May 3, 2022

(54) ANTENNA UNIT AND ANTENNA ARRAY

(71) Applicant: HUAWEI TECHNOLOGIES CO., LTD., Shenzhen (CN)

(72) Inventors: Qingming Xie, Shanghai (CN); Long Li, Xi'an (CN); Guoliang Cao, Shanghai (CN); Rui Shi, Shanghai (CN); Yang Geng, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 15 days.

(21) Appl. No.: 16/898,671

(22) Filed: Jun. 11, 2020

(65) Prior Publication Data

US 2020/0303832 A1 Sep. 24, 2020

Related U.S. Application Data

(63) Continuation of application No. PCT/CN2018/120530, filed on Dec. 12, 2018.

(30) Foreign Application Priority Data

Dec. 15, 2017 (CN) ..... 201711351705.8

(51) Int. Cl.
*H01Q 21/06* (2006.01)
*H01Q 9/04* (2006.01)
*H01Q 21/00* (2006.01)

(52) U.S. Cl.
CPC ..... *H01Q 21/065* (2013.01); *H01Q 9/0414* (2013.01); *H01Q 21/0025* (2013.01)

(58) Field of Classification Search
CPC ..... H01Q 21/0006; H01Q 21/0025; H01Q 21/06; H01Q 21/065; H01Q 21/08;
(Continued)

(56) References Cited

U.S. PATENT DOCUMENTS 6,054,953 A * 4/2000 Lindmark ..... H01Q 1/38 343/700 MS
6,239,762 B1 * 5/2001 Lier ..... H01Q 13/10 343/700 MS (Continued)

FOREIGN PATENT DOCUMENTS

CN 102117970 A 7/2011
CN 202004159 U 10/2011

(Continued)

*Primary Examiner* — Jason Crawford
(74) *Attorney, Agent, or Firm* — Maier & Maier, PLLC

(57) ABSTRACT

An antenna unit and an antenna array. The antenna unit includes M layers of cross metal patches, M layers of dielectric substrates, and a metal ground layer, where M is an integer greater than 1. In addition, an $i^{th}$-layer dielectric substrate is disposed between an $i^{th}$-layer cross metal patch and an $(i+1)^{th}$-layer cross metal patch. The $i^{th}$-layer cross metal patch, the $i^{th}$-layer dielectric substrate, and the $(i+1)^{th}$-layer cross metal patch are sequentially stacked, and i is an integer ranging from 1 to M−1. An $M^{th}$-layer cross metal patch, an $M^{th}$-layer dielectric substrate, and the metal ground layer are sequentially stacked. The antenna unit and the antenna array formed by units may have a good polarization feature, a relatively wide operating bandwidth, and a relatively good phase shift feature.

13 Claims, 8 Drawing Sheets

(58) Field of Classification Search
CPC ..... H01Q 19/04; H01Q 19/0407; H01Q 19/0414; H01Q 5/0006; H01Q 5/0013; H01Q 5/0026
See application file for complete search history.

(56) References Cited

U.S. PATENT DOCUMENTS 6,396,449 B1 * 5/2002 Osterhues ..... H01Q 3/44 343/754
6,452,552 B1 * 9/2002 Ishitobi ..... H01Q 5/357 343/700 MS
9,590,313 B2 * 3/2017 Jan ..... H01Q 9/0457
2003/0071763 A1 * 4/2003 McKinzie, III ..... H01Q 5/357 343/909
2004/0104852 A1 * 6/2004 Choi ..... H01Q 21/065 343/700 MS
2005/0012677 A1 * 1/2005 Brown ..... H01Q 15/0013 343/909
2010/0171675 A1 * 7/2010 Borja ..... H01Q 9/0414 343/798
2011/0001682 A1 * 1/2011 Rao ..... H01Q 5/42 343/893
2012/0212376 A1 * 8/2012 Jan ..... H01Q 9/0435 343/700 MS
2012/0218167 A1 8/2012 He et al.
2015/0194730 A1 * 7/2015 Sudo ..... H01Q 5/378 343/905
2016/0079672 A1 * 3/2016 Cerreno ..... H01Q 21/065 343/848
2019/0020110 A1 * 1/2019 Paulotto ..... H01Q 19/005
2020/0303832 A1 * 9/2020 Xie ..... H01Q 9/0414

FOREIGN PATENT DOCUMENTS

CN 203521603 U 4/2014
CN 105098345 A 11/2015
CN 105140655 A 12/2015
CN 105470661 A 4/2016
CN 105609967 A 5/2016
CN 106207430 A 12/2016
CN 106229649 A 12/2016
EP 2 337 152 A1 6/2011
EP 2 919 322 A1 9/2015

* cited by examiner

ANTENNA UNIT AND ANTENNA ARRAY

CROSS-REFERENCE TO RELATED APPLICATIONS

This application is a continuation of International Application No. PCT/CN2018/120530, filed on Dec. 12, 2018, which claims priority to Chinese Patent Application No. 201711351705.8, filed on Dec. 15, 2017. The disclosures of the aforementioned applications are hereby incorporated by reference in their entireties.

TECHNICAL FIELD

Embodiments relate to the field of communications technologies, and in particular, to an antenna unit and an antenna array.

BACKGROUND

A metasurface antenna is widely used in fields such as electromagnetic communication and radar. With the development and perfection of an electronic wireless communications technology in radar and communications systems, an antenna is desired to have stronger functionality and adaptability. However, due to a feature of a metasurface antenna unit, requirements of both dual polarization and a wide bandwidth cannot be met. Consequently, an application scope of a conventional metasurface antenna is limited.

Linearity of a phase shift curve of an existing metasurface antenna unit is relatively poor. Therefore, an operating bandwidth of a metasurface antenna array is relatively narrow. In addition, because a cross polarization component of a unit that is of the existing metasurface antenna unit and that works in a dual-polarized state is relatively large, it is inconvenient to independently regulate electromagnetic waves with different polarization at the same time.

SUMMARY

Embodiments provide an antenna unit and an antenna array. The antenna unit and the antenna array have a good phase shift feature, can implement a relatively wide operating bandwidth, and facilitate independent regulation of electromagnetic waves with different polarization.

According to a first aspect, an embodiment provides an antenna unit and an antenna array, where the antenna unit includes M layers of cross metal patches, M layers of dielectric substrates, and a metal ground layer, and M is an integer greater than 1. An $i^{th}$-layer dielectric substrate is disposed between an $i^{th}$-layer cross metal patch and an $(i+1)^{th}$-layer cross metal patch, and the $i^{th}$-layer cross metal patch, the $i^{th}$-layer dielectric substrate, and the $(i+1)^{th}$-layer cross metal patch are sequentially stacked, where i is an integer ranging from 1 to M−1. An $M^{th}$-layer cross metal patch, an $M^{th}$-layer dielectric substrate, and the metal ground layer are sequentially stacked.

In an implementation, projection, on a horizontal plane, of a geometric center of each of the M layers of cross metal patches overlaps, and the horizontal plane is a plane parallel to the metal ground layer. Therefore, the antenna unit has a better polarization feature.

In an implementation, shapes of different layers of cross metal patches of the M layers of cross metal patches are the same; or shapes of different layers of cross metal patches of the M layers of cross metal patches are not completely the same; or shapes of different layers of cross metal patches of the M layers of cross metal patches are completely different. Therefore, the antenna unit may be designed based on different requirements.

In an implementation, when the shapes of the different layers of cross metal patches of the M layers of cross metal patches are the same, sizes of the different layers of cross metal patches of the M layers of cross metal patches are the same; or sizes of the different layers of cross metal patches of the M layers of cross metal patches are not completely the same; or sizes of the different layers of cross metal patches of the M layers of cross metal patches are completely different. Therefore, a size of the antenna unit may be determined based on a specific performance requirement.

In an implementation, when the shapes of the different layers of cross metal patches of the M layers of cross metal patches are the same, an area of the $i^{th}$-layer cross metal patch is less than an area of the $(i+1)^{th}$-layer cross metal patch.

In an implementation, the cross metal patch includes two rectangular metal patches that are perpendicular to each other. Optionally, the two rectangular metal patches that are perpendicular to each other are integrally formed, so that the antenna unit is easy to process.

In an implementation, thicknesses of different layers of dielectric plates of the M layers of dielectric substrates are the same; or thicknesses of different layers of dielectric plates of the M layers of dielectric substrates are not completely the same; or thicknesses of different layers of dielectric plates of the M layers of dielectric substrates are completely different.

In an implementation, the antenna unit is an integrally formed multi-layer printed circuit board; alternatively, the antenna unit is formed by bonding a plurality of single-layer printed circuit boards; alternatively, the antenna unit is formed by bonding a plurality of single-layer printed circuit boards and a plurality of multi-layer printed circuit boards.

It can be understood that, according to the antenna unit provided, by using a cross metal patch structure, incident electromagnetic waves with different polarization can be independently regulated, so that the antenna unit has a good polarization feature. In addition, by using a plurality of layers of cross metal patch structures, an operating bandwidth can be increased, and, in addition, a phase shift feature can be improved.

According to a second aspect, an embodiment further provides an antenna array, including the antenna unit according to any one of the first aspect and the implementations of the first aspect.

In an implementation, the antenna array includes a plurality of antenna units, and the plurality of antenna units are periodically arranged.

In an implementation, a spacing between two adjacent antenna units of the plurality of antenna units that are periodically arranged is D, and D is greater than or equal to 0.3 times an operating wavelength and is less than or equal to 0.6 times the operating wavelength. In this way, an antenna pattern feature of the antenna array becomes better.

According to a third aspect, an embodiment further provides an electronic device, including the antenna unit according to any one of the first aspect and the implementations of the first aspect, and/or the antenna array according to any one of the second aspect and the implementations of the second aspect. The electronic device may be a terminal, or a radio access network device.

For beneficial effects of the second aspect and the third aspect, refer to a description of the first aspect. Details are not described herein again.

BRIEF DESCRIPTION OF DRAWINGS

FIG. 2(*b*) is a schematic top view of an antenna unit according to an embodiment;

DETAILED DESCRIPTION OF EMBODIMENTS

To make the objectives, technical solutions, and advantages of the embodiments clearer, the following further describes the embodiments in detail with reference to the accompanying drawings.

A terminal, also referred to as user equipment (UE), is a device providing voice and/or data connectivity to a user, for example, a handheld device or an in-vehicle device with a wireless connection function. For example, a common terminal includes a mobile phone, a tablet computer, a notebook computer, a palmtop computer, a mobile internet device (MID), a wearable device, and customer premises equipment (CPE) such as a smartwatch, a smart band, or a pedometer.

A radio access network (RAN) device, also referred to as a base station, is a device for connecting a terminal to a wireless network, and includes but is not limited to a transmission reception point (TRP), an evolved NodeB (evolved Node B or eNB), a radio network controller (RNC), a NodeB (Node B or NB), a base station controller (BSC), a base transceiver station (BTS), a home base station (for example, a home evolved NodeB, or a home Node B, HNB), and a baseband unit (BBU). In addition, an access network device for next-generation mobile communication, a Wifi access point (AP), and the like, may be further included.

"A plurality of" refers to two or more, and another quantifier is similar to this. The term "and/or" describes an association relationship of associated objects, and represents that three relationships may exist. For example, A and/or B may represent the following three cases: only A exists, both A and B exist, and only B exists. The character "/" generally indicates an "or" relationship of associated objects.

Figure 1:
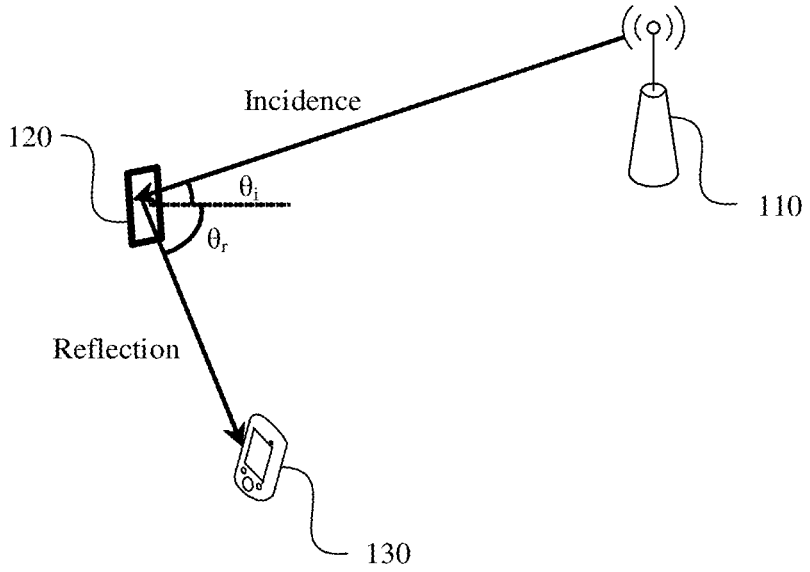
FIG. 1 is an application scenario diagram of an antenna unit according to an embodiment.

With reference to a scenario shown in FIG. 1, the following describes application of an antenna unit provided in an embodiment. A system shown in FIG. 1 includes an access network device 110, an antenna array 120, and a terminal 130. The antenna array 120 is configured to receive an electromagnetic wave signal transmitted by the access network device 110, and reflect the electromagnetic wave signal to the terminal 130, so that the access network device 110 and the terminal 130 can communicate with each other.

It can be understood that the antenna array 120 in FIG. 1 is used as a reflective antenna array. Therefore, the antenna array 120 may be a passive antenna array, and the antenna array 120 may also be referred to as a metasurface antenna array.

Figure 2A:
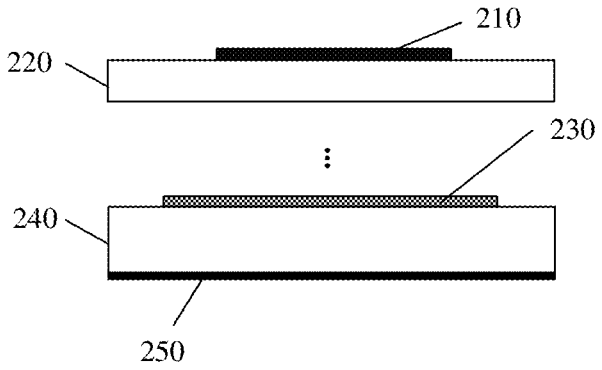
FIG. 2(*a*) is a schematic main view of an antenna unit according to an embodiment.
Figure 2B:
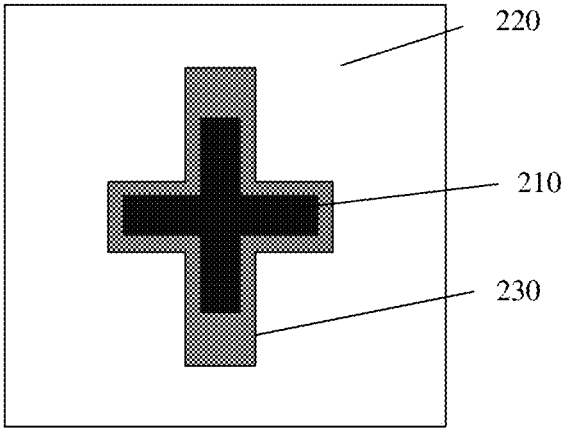

This embodiment provides an antenna unit and an antenna array, and the antenna array may be used as a reflective antenna array. FIG. 2(*a*) and FIG. 2(*b*) are schematic structural diagrams of an antenna unit 200 according to this embodiment. FIG. 2(*a*) is a main view of the antenna unit 200, and FIG. 2(*b*) is a top view of the antenna unit 200. The antenna unit 200 includes M layers of cross metal patches, M layers of dielectric substrates, and a metal ground layer, where M is an integer greater than 1. In addition, an $i^{th}$-layer dielectric substrate is disposed between an $i^{th}$-layer cross metal patch and an $(i+1)^{th}$-layer cross metal patch. The $i^{th}$-layer cross metal patch, the $i^{th}$-layer dielectric substrate, and the $(i+1)^{th}$-layer cross metal patch are sequentially stacked, where i is an integer ranging from 1 to M−1. An $M^{th}$-layer cross metal patch, an $M^{th}$-layer dielectric substrate, and the metal ground layer are sequentially stacked. The antenna unit 200 shown in FIG. 2 merely shows a first-layer cross metal patch 210, a first-layer dielectric substrate 220, an $M^{th}$-layer cross metal patch 230, an $M^{th}$-layer dielectric substrate 240, and a metal ground layer 250. The $i^{th}$-layer cross metal patch and the $i^{th}$-layer dielectric substrate in the middle are omitted in the figure (an omission is indicated by three points in the main view), where i is an integer ranging from 1 to M−1.

Sizes and shapes of cross metal patches shown in FIG. 2 are merely examples, and are not limited in this embodiment. In addition, a thickness of the dielectric substrate shown in FIG. 2 is also an example, and is not limited in this embodiment.

It can be understood that, by using a cross metal patch structure provided in this embodiment, incident electromagnetic waves with different polarization can be independently regulated, so that the antenna unit 200 may have a good polarization feature. In addition, by using a plurality of layers of cross metal patch structures, an operating bandwidth can be increased, and in addition, a phase shift feature can be improved.

Further, an antenna array formed by periodically arranging antenna units 200 provided in this embodiment may have a good phase shift feature.

Figure 3:
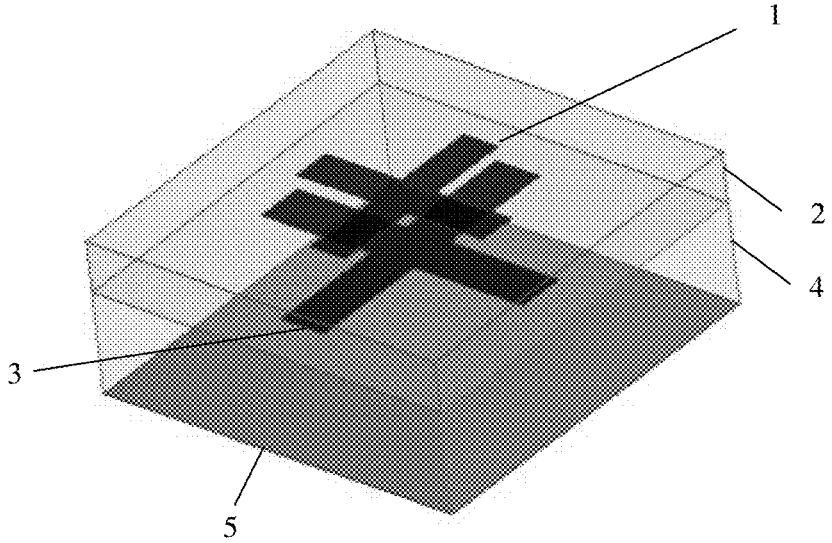
FIG. 3 is a schematic diagram of a 3D structure of an antenna unit according to an embodiment.
Figure 4:
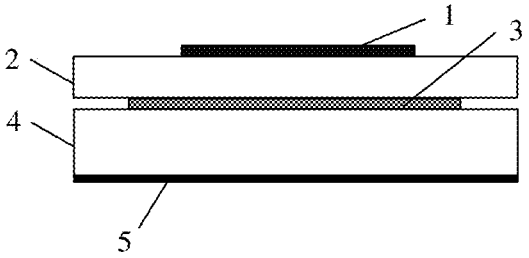
FIG. 4 is a schematic main view of an antenna unit according to an embodiment.
Figure 5:
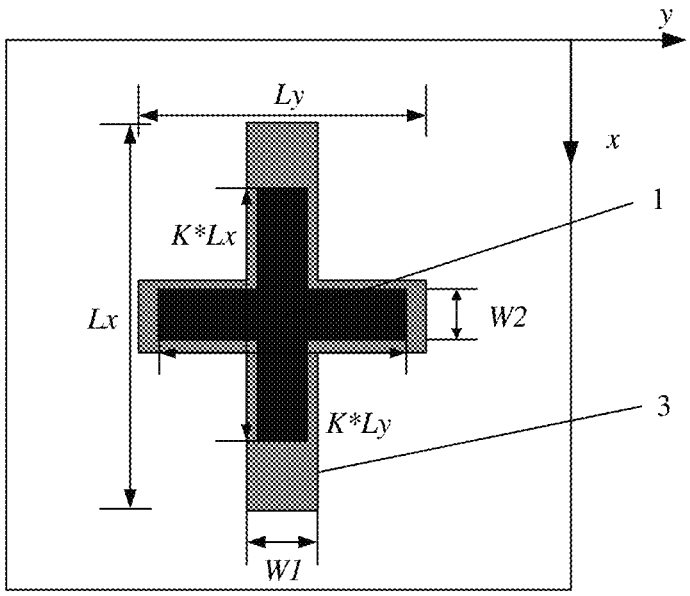
FIG. 5 is a schematic top view of an antenna unit according to an embodiment.

For ease of description, the following uses an antenna unit 300 with double layers of cross metal patches as an example. That is, the antenna unit 300 is an antenna unit when M in the antenna unit 200 shown in FIG. 2 is equal to 2. Referring to FIG. 3 to FIG. 5, FIG. 3 is a schematic diagram of a 3D structure of the antenna unit 300, FIG. 4 is a schematic main view of a structure of the antenna unit 300, and FIG. 5 is a schematic top view of a structure of the antenna unit 300. The antenna unit 300 includes a first-layer cross metal patch (1), a first-layer dielectric substrate (2), a second-layer cross metal patch (3), a second-layer dielectric substrate (4), and a metal ground layer (5) that are sequentially stacked.

Projection of a geometric center of the first-layer cross metal patch (1) overlaps projection of a geometric center of the second-layer cross metal patch (3) on a horizontal plane, and the horizontal plane is a plane parallel to the metal ground layer.

To facilitate comparison of an area relationship between the first-layer cross metal patch (1) and the second-layer cross metal patch (3), both the first-layer cross metal patch (1) and the second-layer cross metal patch (3) shown in FIG. 3 and FIG. 5 are regular cross metal patch structures. Optionally, shapes of the first-layer cross metal patch (1) and the second-layer cross metal patch (3) may be different. For example, the first-layer cross metal patch (1) is a cross metal patch with an arc edge, and the second-layer cross metal patch (3) is a cross metal patch with a jagged edge. A specific shape of the cross metal patch is not limited in this embodiment.

For example, the first-layer cross metal patch (1) or the second-layer the cross metal patch (3) have two rectangular metal patches that are perpendicular to each other. The two rectangular metal patches of the first-layer cross metal patch (1) or the second-layer cross metal patch (3) may be integrally formed. Two rectangular metal patches that form the first-layer cross metal patch (1) or two rectangular metal patches that form the second-layer cross metal patch (3) shown in FIG. 3 and FIG. 5 have different sizes and overlapping geometric centers.

Optionally, the two rectangular metal patches that form the first-layer cross metal patch (1) or the two rectangular metal patches that form the second-layer cross metal patch (3) may have same sizes, and overlapping or no overlapping geometric centers. This is merely an example, and is not limited in this embodiment.

Still referring to FIG. 5, lengths of the two rectangular metal patches of the second-layer cross metal patch (3) are respectively Lx and Ly, and widths of the two rectangular metal patches are equal and are W1. Lengths of the two rectangular metal patches of the first-layer cross metal patch (1) are respectively K*Lx and K*Ly, and widths of the two rectangular metal patches are equal and are W2, where K is greater than 0 and less than 1. It can be understood from FIG. 5 that W1 is greater than W2. Therefore, an area of the first-layer cross metal patch (1) is less than an area of the second-layer cross metal patch (3).

Optionally, the area of the first-layer cross metal patch (1) may be greater than or equal to the area of the second-layer cross metal patch (3). This is not limited in this embodiment, and is merely an example.

Still referring to FIG. 4, it can be understood that thicknesses of the first-layer dielectric substrate (2) and the second-layer dielectric substrate (4) shown in the figure are different. Optionally, the thicknesses of the first-layer dielectric substrate (2) and the second-layer dielectric substrate (4) are the same. This is not limited in this embodiment.

For performance of the antenna unit 300, refer to electromagnetic simulation result diagrams shown in FIG. 6 to FIG. 9. In electromagnetic simulation software HFSS, a port and a boundary condition are properly set and a center frequency at which the antenna unit 300 operates is obtained to be 28 GHz through full-wave simulation. For a change relationship between a reflection phase of the antenna unit 300 and Lx or Ly, it is verified through simulation that a rule of the reflection phase of the antenna unit 300 obtained after Ly is fixed and Lx is separately adjusted is similar to a rule of the reflection phase of the antenna unit 300 obtained after Lx is fixed and Ly is separately adjusted. Therefore, referring to FIG. 6, a horizontal coordinate L in the figure may represent a relationship between Lx and the reflection phase, and also represent a relationship between Ly and the reflection phase. The reflection phase is a phase of an electromagnetic wave obtained after the antenna unit 300 reflects an incident electromagnetic wave. It can be understood from FIG. 6 that, as L (or Lx, or Ly) increases, the reflection phase presents a trend of approximating a linear change, that is, linearity of a phase shift curve of the antenna 300 is relatively good, and a phase shift coverage area exceeds 360°.

Figure 6:
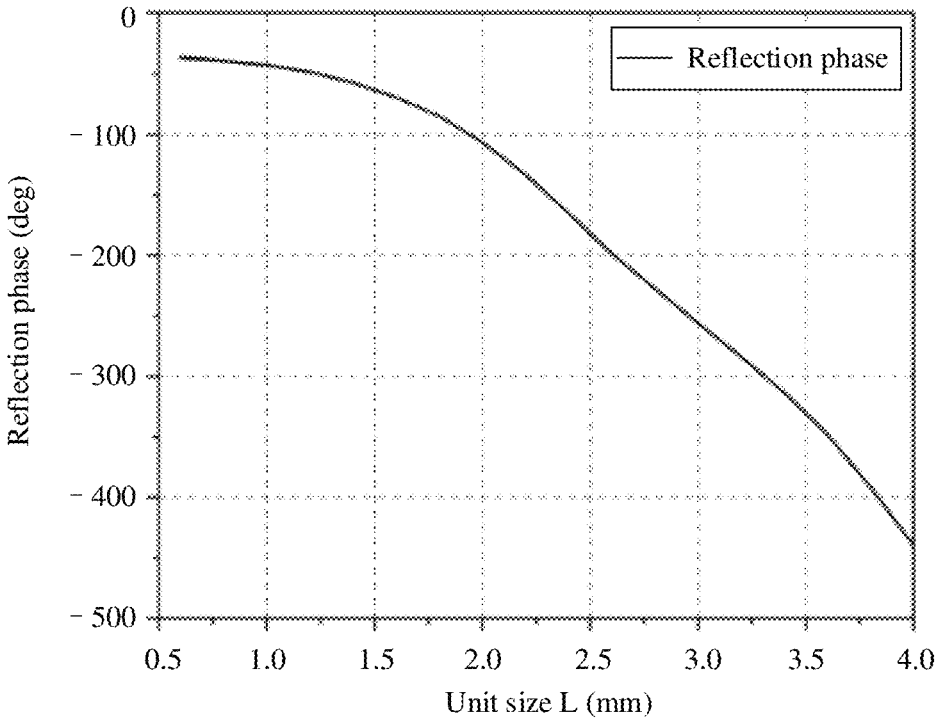
FIG. 6 is a reflection phase line graph of an antenna unit according to an embodiment.
Figure 7:
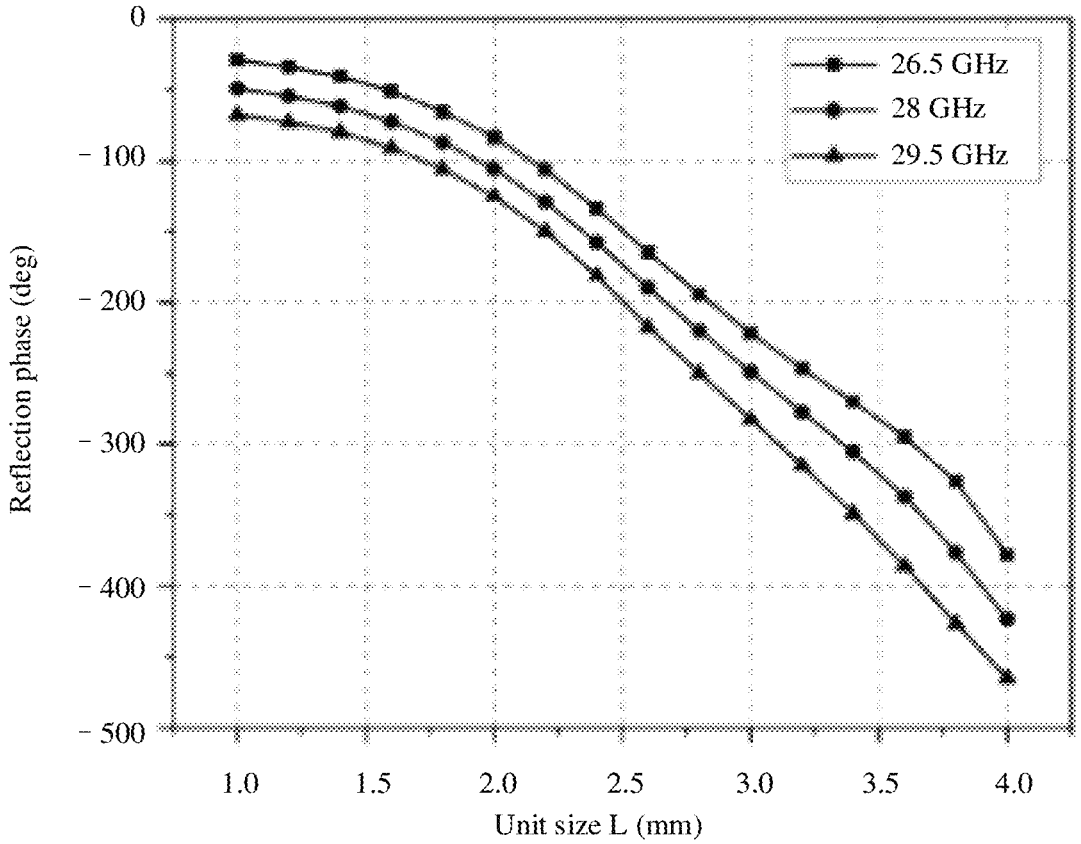
FIG. 7 is a reflection phase line graph of an antenna unit varying with a frequency according to an embodiment.

Further referring to FIG. 7, based on FIG. 6, simulation of 26.5 GHz and 29.5 GHz is added in FIG. 7. It can be understood that trends of three phase shift curves corresponding to three frequencies in FIG. 7 are similar. Therefore, the antenna unit 300 may maintain good phase shift linearity within a relatively wide operating bandwidth.

Figure 8:
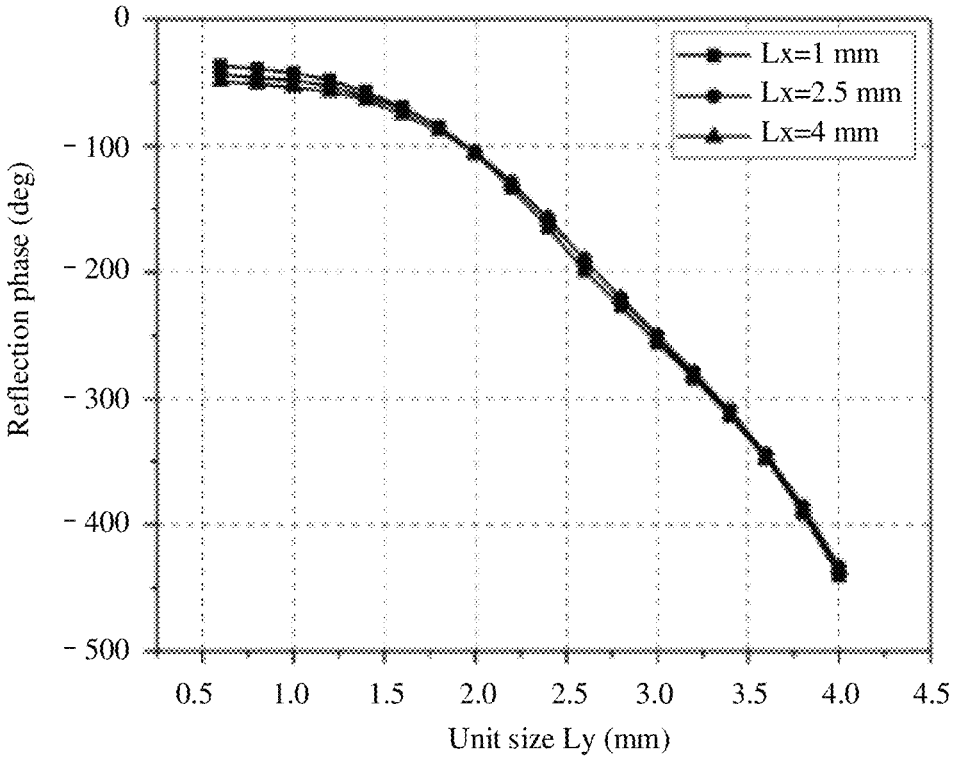
FIG. 8 is a reflection phase line graph of an antenna unit varying with a cross polarization size according to an embodiment.

Referring to FIG. 8, when Lx is fixed to 1 mm, 2.5 mm, and 4 mm, respectively, and Ly is adjusted, a change trend of the reflection phase is shown in FIG. 8. It can be understood that trends of three phase shift curves in the figure are very close. Referring to FIG. 5, a side length Lx of an x-polarization direction has little impact on a phase curve of a y-polarization direction. Therefore, the antenna unit 300 provided in this embodiment has a relatively good polarization feature, and can independently regulate a reflection phase of the x-polarization and a reflection phase of the y-polarization respectively.

Figure 9:
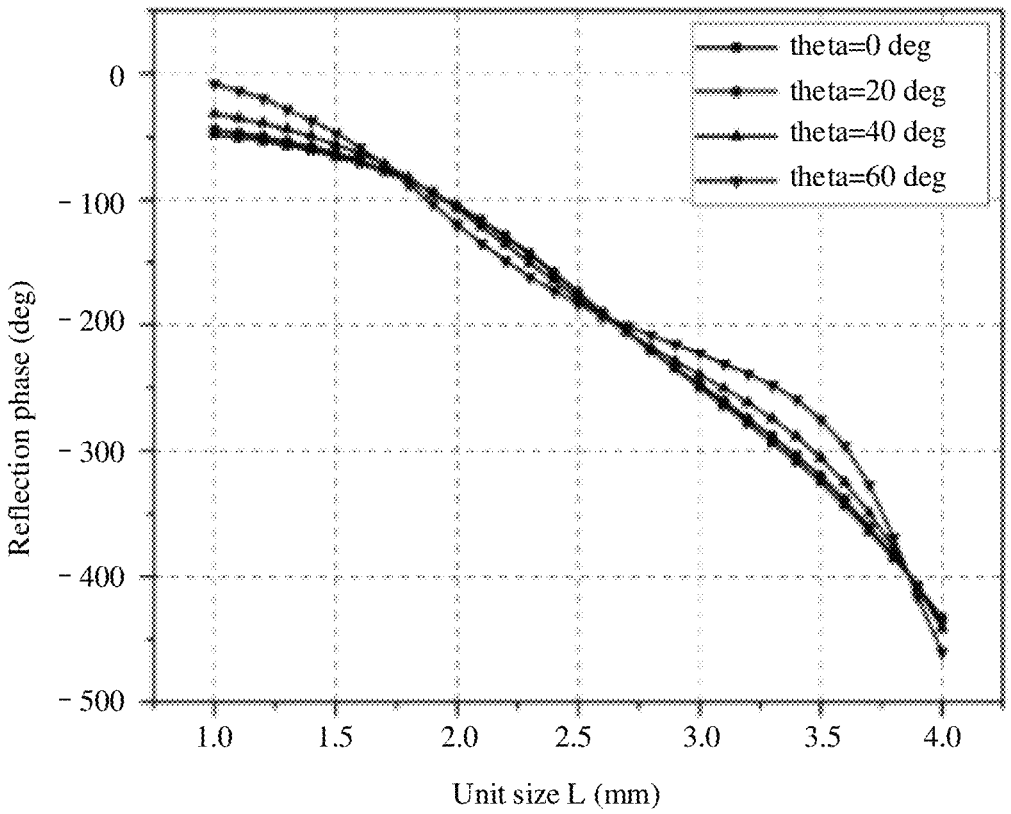
FIG. 9 is a reflection phase line graph of an antenna unit varying with an incident angle according to an embodiment.

In addition, referring to FIG. 9, to observe relationships between different incident angles theta and reflection phase amounts, based on FIG. 6, simulation results of incident angles theta of 20°, 40°, and 60° (corresponding to 20 deg, 40 deg, and 60 deg in the figure) are added in FIG. 9. It can be understood that, in FIG. 9, trends of phase shift curves corresponding to four different incident angles are similar. When an incident angle changes from 0° to 60°, a reflection phase curve changes slightly. Therefore, the antenna unit 300 provided in this embodiment has relatively good incident angle stability.

Thus, the antenna unit 300 provided in this embodiment has the relatively good phase shift feature, the relatively good polarization feature, the relatively good incident angle stability, and the relatively wide operating bandwidth.

Figure 10:
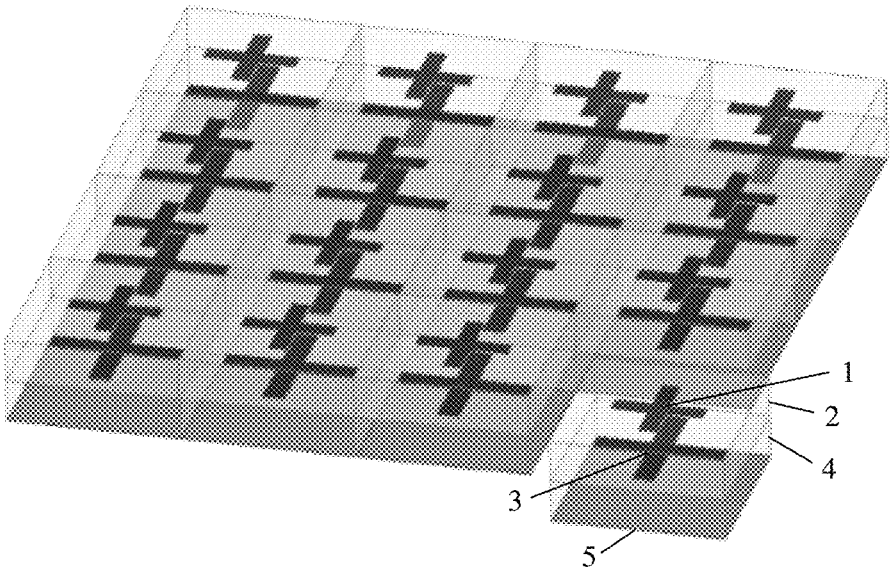
FIG. 10 is a schematic structural diagram of an antenna array according to an embodiment.

In addition, the antenna units provided in this embodiment may be periodically arranged to form an antenna array. FIG. 10 shows an antenna array 1000 according to an embodiment. The antenna array shown in FIG. 10 is formed by periodically arranging the foregoing antenna units 300. In addition, the antenna array 1000 is a 4*4 antenna array, that is, the antenna array 1000 is a 4 rows by 4 columns antenna array. Optionally, the antenna units forming the antenna array 1000 may be antenna units having three layers of cross metal patches or other antenna units having a plurality of layers of cross metal patches, and are not limited in this embodiment. Optionally, the antenna array 1000 may be a 2*4 antenna array, an 8*8 antenna array, or a 4*16 antenna array. A quantity and an arrangement of the antenna units in the antenna array 1000 are not limited in this embodiment.

Figure 11:
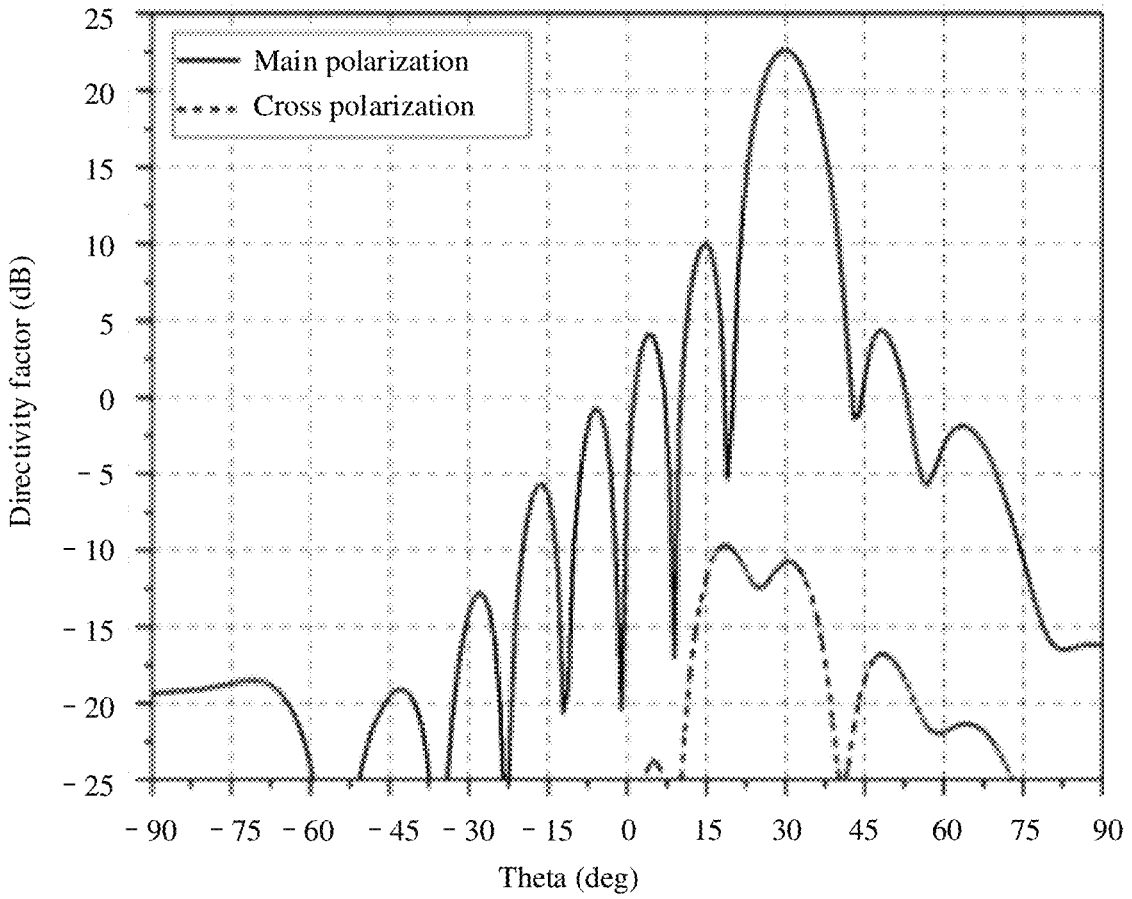
FIG. 11 is a simulation antenna pattern of an antenna array according to an embodiment.

FIG. 11 is a simulation antenna pattern of an antenna array 1100 according to an embodiment. The antenna array 1100 is formed by periodically arranging the foregoing antenna units 300, and is a 16*16 antenna array. A spacing between adjacent antenna units 300 is D. For example, D in this embodiment is equal to 0.5 times an operating wavelength (not shown in the figure). In FIG. 11, a Theta on a horizontal coordinate is an angle of an antenna beam in a horizontal direction, and a unit is a degree (deg). A vertical coordinate shows a directivity factor value, and a unit is a decibel (dB). A solid-line curve is a curve in which a value of a directivity factor of the antenna array 1100 varies, in a main polarization direction, with a Theta angle, that is, an antenna pattern curve of main polarization. A dashed-line curve is a curve in which a value of a directivity factor of the antenna array 1100 varies, in a cross polarization direction, with the Theta angle, that is, an antenna pattern curve of cross polarization. It can be understood that in a beam direction of the array, that is, in a direction in which the Theta is 30 deg, a (maximum) directivity factor is 22.5 dB, and a cross polarization component in the direction is less than −10 dB. Therefore, the antenna array 1100 provided in this embodiment has a good polarization feature.

Optionally, the spacing D between the two adjacent antenna units 300 of the antenna array 1100 provided in this embodiment is 0.3 times the operating wavelength. For example, D may be greater than or equal to 0.3 times the operating wavelength, and less than or equal to 0.6 times the operating wavelength. A size of D is not limited in this embodiment.

In addition, sizes of all of the antenna units 300 in the antenna array 1100 may be the same or may be different. For example, the sizes of all of the antenna units 300 in the antenna array 1100 may be designed based on an actual phase shift requirement. The sizes of all of the antenna units 300 in the antenna array 1100 are not limited in this embodiment.

Figure 12:
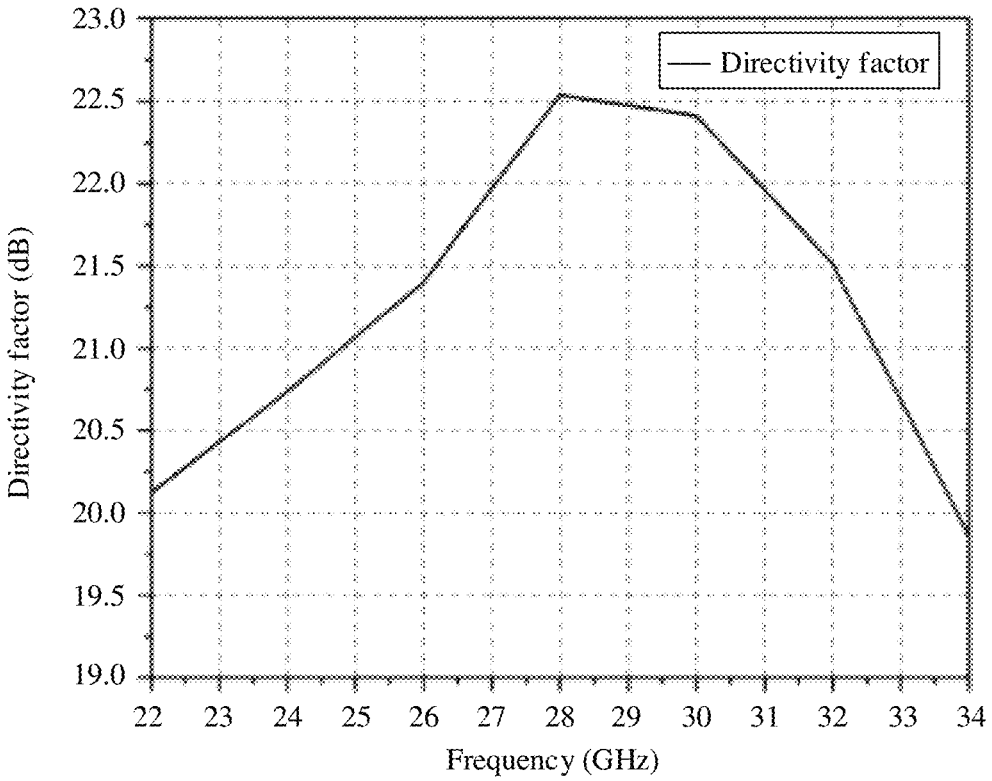
FIG. 12 is a line graph in which a directivity factor of an antenna array varies with a frequency according to an embodiment.

Further referring to FIG. 12, based on FIG. 11, FIG. 12 further describes a relationship in which a directivity factor varies with a frequency. In FIG. 12, a horizontal coordinate shows a frequency (GHz), and a vertical coordinate shows a directivity factor (dB). It can be understood that when an operating frequency is 28 GHz, a maximum directivity factor is 22.5 dB, a 1 dB gain bandwidth is ranging from 26.2 GHz to 32 GHz, and a relative bandwidth is approximately 21%. Therefore, the antenna array 1100 provided in this embodiment has a relatively wide operating bandwidth.

The foregoing descriptions are merely implementations of embodiments, but are not intended to limit the protection scope of this application. Any variation or replacement readily figured out by a person of ordinary skill in the art within the scope disclosed in the embodiments shall fall within the protection scope of this application.

What is claimed is:

1. An antenna unit, comprising: M layers of cross metal patches, M layers of dielectric substrates, and a metal ground layer, wherein M is an integer greater than 1;

an $i^{th}$-layer dielectric substrate is disposed between an $i^{th}$-layer cross metal patch and an $(i+1)^{th}$-layer cross metal patch, and the $i^{th}$-layer cross metal patch, the $i^{th}$-layer dielectric substrate and the $(i+1)^{th}$-layer cross metal patch are sequentially stacked in a first sequential stack, wherein i is an integer ranging from 1 to M−1; and an $M^{th}$-layer cross metal patch, an $M^{th}$-layer dielectric substrate, and the metal ground layer are sequentially stacked in a second sequential stack;

wherein each element in each of the first sequential stack and the second sequential stack is disposed entirely above or entirely below adjoining elements in the first sequential stack or the second sequential stack.

2. The antenna unit according to claim 1, wherein projection, on a horizontal plane, of a geometric center of each of the M layers of cross metal patches overlaps, and the horizontal plane is a plane parallel to the metal ground layer.

3. The antenna unit according to claim 1, wherein shapes of different layers of cross metal patches of the M layers of cross metal patches are the same; or shapes of different layers of cross metal patches of the M layers of cross metal patches are not completely the same; or shapes of different layers of cross metal patches of the M layers of cross metal patches are completely different.

4. The antenna unit according to claim 3, wherein when the shapes of the different layers of cross metal patches of the M layers of cross metal patches are the same, sizes of the different layers of cross metal patches of the M layers of cross metal patches are the same; or sizes of the different layers of cross metal patches of the M layers of cross metal patches are not completely the same; or sizes of the different layers of cross metal patches of the M layers of cross metal patches are completely different.

5. The antenna unit according to claim 3, wherein when the shapes of the different layers of cross metal patches of the M layers of cross metal patches are the same, an area of the $i^{th}$-layer cross metal patch is less than an area of the $(i+1)^{th}$-layer cross metal patch.

6. The antenna unit according to claim 1, wherein the cross metal patch comprises two rectangular metal patches that are perpendicular to each other.

7. The antenna unit according to claim 6, wherein the two rectangular metal patches that are perpendicular to each other are integrally formed.

8. The antenna unit according to claim 1, wherein thicknesses of different layers of dielectric plates of the M layers of dielectric substrates are the same; or thicknesses of different layers of dielectric plates of the M layers of dielectric substrates are not completely the same; or thicknesses of different layers of dielectric plates of the M layers of dielectric substrates are completely different.

9. The antenna unit according to claim 1, wherein the antenna unit is an integrally formed multi-layer printed circuit board; or the antenna unit is formed by bonding a plurality of single-layer printed circuit boards; or the antenna unit is formed by bonding a plurality of single-layer printed circuit boards and a plurality of multi-layer printed circuit boards.

10. An antenna array, comprising an antenna unit, the antenna unit comprising M layers of cross metal patches, M layers of dielectric substrates, and a metal ground layer, wherein M is an integer greater than 1;

an $i^{th}$-layer dielectric substrate is disposed between an $i^{th}$-layer cross metal patch and an $(i+1)^{th}$-layer cross metal patch, and the $i^{th}$-layer cross metal patch, the $i^{th}$-layer dielectric substrate and the $(i+1)^{th}$-layer cross metal patch are sequentially stacked in a first sequential stack, wherein i is an integer ranging from 1 to M−1; and an $M^{th}$-layer cross metal patch, an $M^{th}$-layer dielectric substrate, and the metal ground layer are sequentially stacked in a second sequential stack;

wherein each element in each of the first sequential stack and the second sequential stack is disposed entirely above or entirely below adjoining elements in the first sequential stack or the second sequential stack.

11. The antenna array according to claim 10, wherein the antenna array comprises a plurality of antenna units, and the plurality of antenna units are periodically arranged.

12. The antenna array according to claim 11, wherein a spacing between adjacent antenna units of the plurality of antenna units is D, and D is greater than or equal to 0.3 times an operating wavelength and is less than or equal to 0.6 times the operating wavelength.

13. An electronic device, comprising an antenna unit, the antenna unit comprising M layers of cross metal patches, M layers of dielectric substrates, and a metal ground layer, wherein M is an integer greater than 1;

an $i^{th}$-layer dielectric substrate is disposed between an $i^{th}$-layer cross metal patch and an $(i+1)^{th}$-layer cross metal patch, and the $i^{th}$-layer cross metal patch, the $i^{th}$-layer dielectric substrate and the $(i+1)^{th}$-layer cross metal patch are sequentially stacked in a first sequential stack, wherein i is an integer ranging from 1 to M−1; and an $M^{th}$-layer cross metal patch, an $M^{th}$-layer dielectric substrate, and the metal ground layer are sequentially stacked in a second sequential stack;

wherein each element in each of the first sequential stack and the second sequential stack is disposed entirely above or entirely below adjoining elements in the first sequential stack or the second sequential stack.

* * * * *